US011167440B2

(12) United States Patent
Woosencraft et al.

(10) Patent No.: US 11,167,440 B2
(45) Date of Patent: Nov. 9, 2021

(54) VARIABLE LOG SAW FOR CORELESS ROLLS

(71) Applicant: GPCP IP Holdings LLC, Atlanta, GA (US)

(72) Inventors: Daniel J. Woosencraft, Green Bay, WI (US); Nicholas T. Sanders, Pulaski, WI (US)

(73) Assignee: GPCP IP Holdings LLC, Allanta (GE)

( * ) Notice: Subject to any disclaimer, the term of this patent is extended or adjusted under 35 U.S.C. 154(b) by 0 days.

(21) Appl. No.: 16/392,890

(22) Filed: Apr. 24, 2019

(65) Prior Publication Data

US 2019/0248036 A1 Aug. 15, 2019

Related U.S. Application Data

(62) Division of application No. 14/884,493, filed on Oct. 15, 2015, now Pat. No. 10,328,592.

(60) Provisional application No. 62/081,337, filed on Nov. 18, 2014.

(51) Int. Cl.

| | |
|---|---|
| ***B26D 3/16*** | (2006.01) |
| ***B26D 5/00*** | (2006.01) |
| *B26D 1/16* | (2006.01) |

(52) U.S. Cl.

CPC ..... *B26D 3/16* (2013.01); *B26D 5/005* (2013.01); *B26D 1/16* (2013.01); *B26D 2210/11* (2013.01)

(58) Field of Classification Search

CPC . B26D 3/16; B26D 5/005; B26D 1/16; B26D 2210/11; Y10T 83/885; Y10T 83/2074; Y10T 83/0467; Y10T 83/9372; B23D 45/124; B23D 45/126; B27B 17/005

USPC ..... 83/13, 54, 102, 74, 27, 663, 674, 675, 83/733, 368, 371, 79, 80, 360, 90–100

See application file for complete search history.

(56) References Cited

U.S. PATENT DOCUMENTS

| | | | | |
|---|---|---|---|---|
| 3,213,734 A | | 10/1965 | Nystrand et al. | |
| 4,091,698 A | | 5/1978 | Obear et al. | |
| 4,620,465 A | * | 11/1986 | Taguchi | B23D 55/06 83/311 |
| 4,901,611 A | | 2/1990 | Bentley et al. | |
| 4,981,129 A | * | 1/1991 | Osterman | B27B 17/02 125/21 |
| 5,271,137 A | * | 12/1993 | Schutz | B26D 3/16 242/533.7 |
| 5,453,070 A | * | 9/1995 | Moody | B26D 3/164 493/288 |
| 6,659,387 B2 | | 12/2003 | Biagioni et al. | |
| 6,718,853 B2 | | 4/2004 | Butterworth et al. | |
| 7,178,436 B2 | | 2/2007 | Wilson et al. | |

(Continued)

FOREIGN PATENT DOCUMENTS

| | | |
|---|---|---|
| JP | 07223193 A | 8/1995 |
| JP | 07223195 A | 8/1995 |

(Continued)

*Primary Examiner* — Ghassem Alie

(74) *Attorney, Agent, or Firm* — Laura L. Bozek

(57) ABSTRACT

The present disclosure is directed to a method for cutting a coreless rolled paper product. The method includes defining a core offset value for a cut, the cut having a starting point and an ending point, setting a plunge speed for a saw to a first plunge speed, and changing the plunge speed to a second plunge speed when the saw reaches the core offset value.

6 Claims, 7 Drawing Sheets

(56) References Cited

U.S. PATENT DOCUMENTS

| | | | | |
|---|---|---|---|---|
| 2002/0007711 | A1* | 1/2002 | Smith | B23D 59/001 83/76 |
| 2002/0066937 | A1* | 6/2002 | Hosaka | H01L 31/02325 257/433 |
| 2003/0097917 | A1* | 5/2003 | Virvalo | B27B 17/0058 83/74 |
| 2003/0172787 | A1* | 9/2003 | Wallace | B23D 57/02 83/102 |
| 2005/0022643 | A1 | 2/2005 | Weidner et al. | |
| 2005/0109176 | A1* | 5/2005 | Wilson | B23D 59/001 83/13 |
| 2011/0162499 | A1* | 7/2011 | Cooper | B26D 5/32 83/76.8 |
| 2016/0136830 | A1 | 5/2016 | Woosencraft et al. | |

FOREIGN PATENT DOCUMENTS

| | | | |
|---|---|---|---|
| JP | 10058382 | A | 3/1998 |
| WO | 0138053 | A1 | 5/2001 |

* cited by examiner

VARIABLE LOG SAW FOR CORELESS ROLLS

CROSS REFERENCE TO RELATED APPLICATIONS

This application is a divisional application of copending U.S. patent application Ser. No. 14/884,493, filed Oct. 15, 2015, which is based on U.S. Provisional Patent Application No. 62/081,337, filed Nov. 18, 2014, which are incorporated herein in their entirety.

DESCRIPTION

The present disclosure relates generally to log saws for cutting through coreless tissue rolls, and more particularly, to systems and methods for cutting the roll using a variable plunge speed that is regulated during a cut to decrease collapse near the center of the tissue roll.

Many tissue products, such as bath tissues and paper towels, are manufactured and sold as spirally wound rolls. Rolled paper products, such as bath tissue, are generally provided in one of two forms, coreless rolls or cored rolls. Cored rolls are commonly used for residential and light commercial use and include a supporting tube disposed in the center aperture of the roll with the tissue product wrapped around the supporting tube. Typically, the tubular core is made from a rigid paperboard material. The tubular core is useful since it allows for the product to be dispensed from a holder that is inserted through the tubular core. Bath tissue holders, for instance, typically include a spindle that extends through the hollow core. Once placed on the spindle, the bath tissue roll can be easily unwound and used by the consumer. Once a spirally wound tissue product is exhausted or consumed, however, the consumer is left with the tubular core that is usually discarded. The tubular core not only increases the cost of the tissue product, but also represents waste that has an adverse environmental impact if not recycled.

Coreless rolls are commonly used in commercial buildings and generally include tissue wound very densely around a small center aperture. However, since coreless roll products do not include a supporting tube to provide stability, the coreless roll products are prone to being crushed during converting. When a coreless roll product is crushed, i.e., when the center aperture of the coreless roll is at least partially deformed, the coreless roll product may be difficult to insert onto a spindle for dispensing. Another drawback to past designs is that the opening formed in the product is either very small, is non-existent or is non-circular. Non-circular openings, for instance, do not rotate as easily on spindles. Products having a very small opening or no opening at all, on the other hand, require a special adaptor to dispense the product.

In the making of rolled paper goods, smaller end product rolls are generally cut or segmented from a longer master roll using a circular log saw. A typical log saw has a saw blade that articulates between a raised position and a lowered position. The saw blade is lowered to cut the master roll and is then raised so that the roll may be moved to the next segmenting point, referred to as indexing. As the log of paper is indexed along, the saw blade raises and lowers to affect the necessary cuts. As used herein, the articulation of the saw blade between and raised position and a lowered position is referred to as the saws "plunge." Example, of typical prior art articulating log saws are illustrated in FIGS. 1-3. Heretofore, the blade rotation speed was generally continuous and high during the entire cut to maintain adequate throughput. The saw plunge speed was also generally kept constant, i.e., the blade enters the paper roll, enters and exits the center aperture and leaves the roll at the same speed.

This traditional high-saw-speed, single-plunge-speed saw damages the structure of coreless rolls and the innermost plies of tissue paper as it cuts through the core and collapses the tissue roll, thus lowering the quality of the tissue roll. It has been discovered that regulating the plunge speed, for example, as it approaches the tissue core, results in improved product quality while maintaining or increasing throughput rates.

According to one aspect, the present disclosure is directed to a method for cutting a coreless rolled paper product. The method may include defining a core offset value for a cut, the cut having a starting point and an ending point. The method may also include setting a first plunge speed and changing the plunge speed to a second speed when the saw reaches the core offset value.

In accordance with another aspect, the present disclosure is directed to a system for cutting a coreless rolled paper product. The system may include an output to communicate with a saw 100 and a controller 10 (as seen in FIG. 3) communicatively coupled to the saw 100 through the output. The controller 10 may be programmed to identify or determine a core offset value for a cut, the cut having a starting point and an ending point and the controller may identify or determine a throughput rate and a first plunge speed for the saw. The controller 10 may also be configured to identify or determine a second plunge speed based on at least one of the throughput rate, the core offset value, and the first plunge speed. As used herein values that are uploaded to the controller 10 are "identified" by the controller and values that are determined are calculated based upon other variables that are identified to the controller 10.

The present disclosure further describes a log saw cutting profile that minimizes roll crush and tissue damage at the core, resulting in a higher quality product. The system and method described herein overcome the significant problems associated with the production of coreless tissue rolls as set forth above.

DETAILED DESCRIPTION

The present invention relates to a method of forming a coreless paper roll product, such as tissue or toweling, which includes cutting the product from an elongated coreless master roll or paper log in a manner that minimizes disturbance of the central aperture of both the end product and the elongated coreless paper roll from which it is cut.

In exemplary embodiments, methods and systems are provided for converting a coreless roll product. As used herein, the terms "coreless roll product, "coreless roll," "coreless paper roll product," and "coreless paper product" are all understood to be interchangeable except where specifically indicated as different or where one of ordinary skill in the art would understand them to be different and refer to rolled paper products that have a center aperture which does not include a supporting tube.

As used herein "plunge speed," or "plunge" refers to the rate at which a saw is raised or lowered during a cutting operation.

As used herein "blade speed," "saw blade speed," and "saw speed" are interchangeable and refer to the rate of rotation of the saw blade.

In exemplary embodiments, the center aperture can range from approximately one half inch to four inches in diameter, or about 10 to 100 millimeters. In exemplary embodiments, coreless roll products can include a wide variety of paper products such as bath tissue, paper towels, napkins, thermal paper, or the like.

Figure 1:
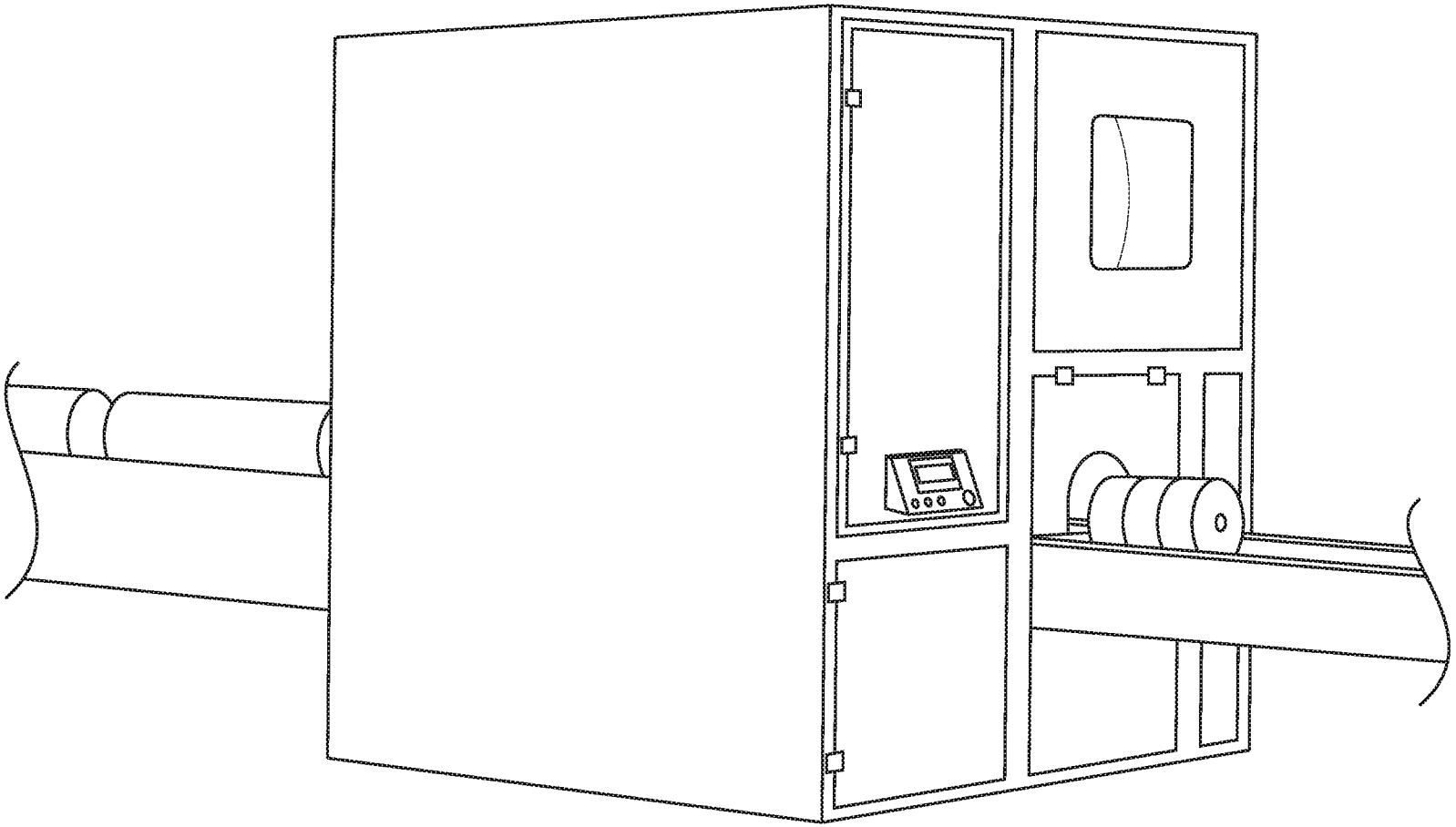
FIG. 1 (PRIOR ART)
FIG. 1 is a perspective view of a prior art log saw system for product rolls from a master roll.
Figure 2:
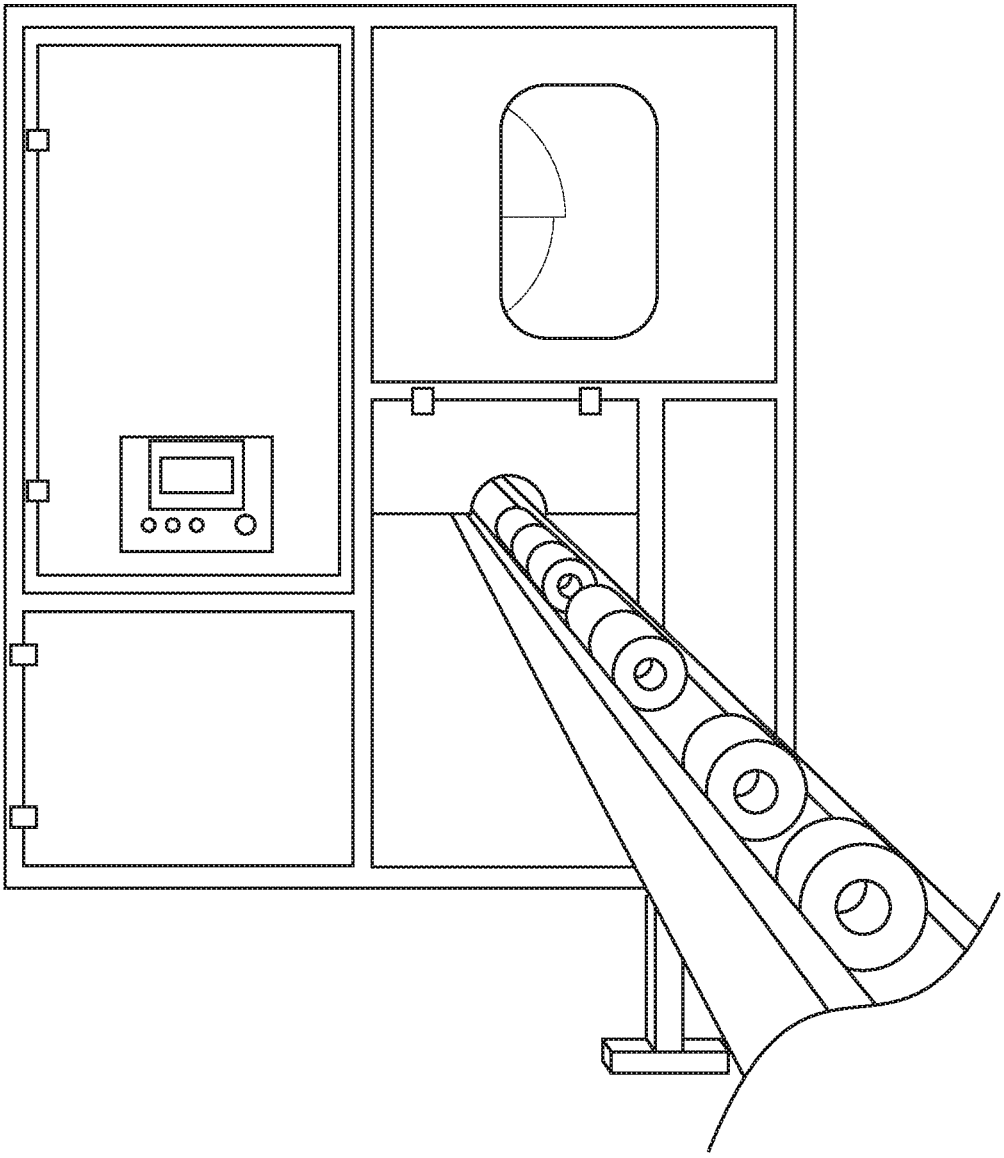
FIG. 2 (PRIOR ART)
FIG. 2 is a front view of the prior art log saw system of FIG. 1.
Figure 3:
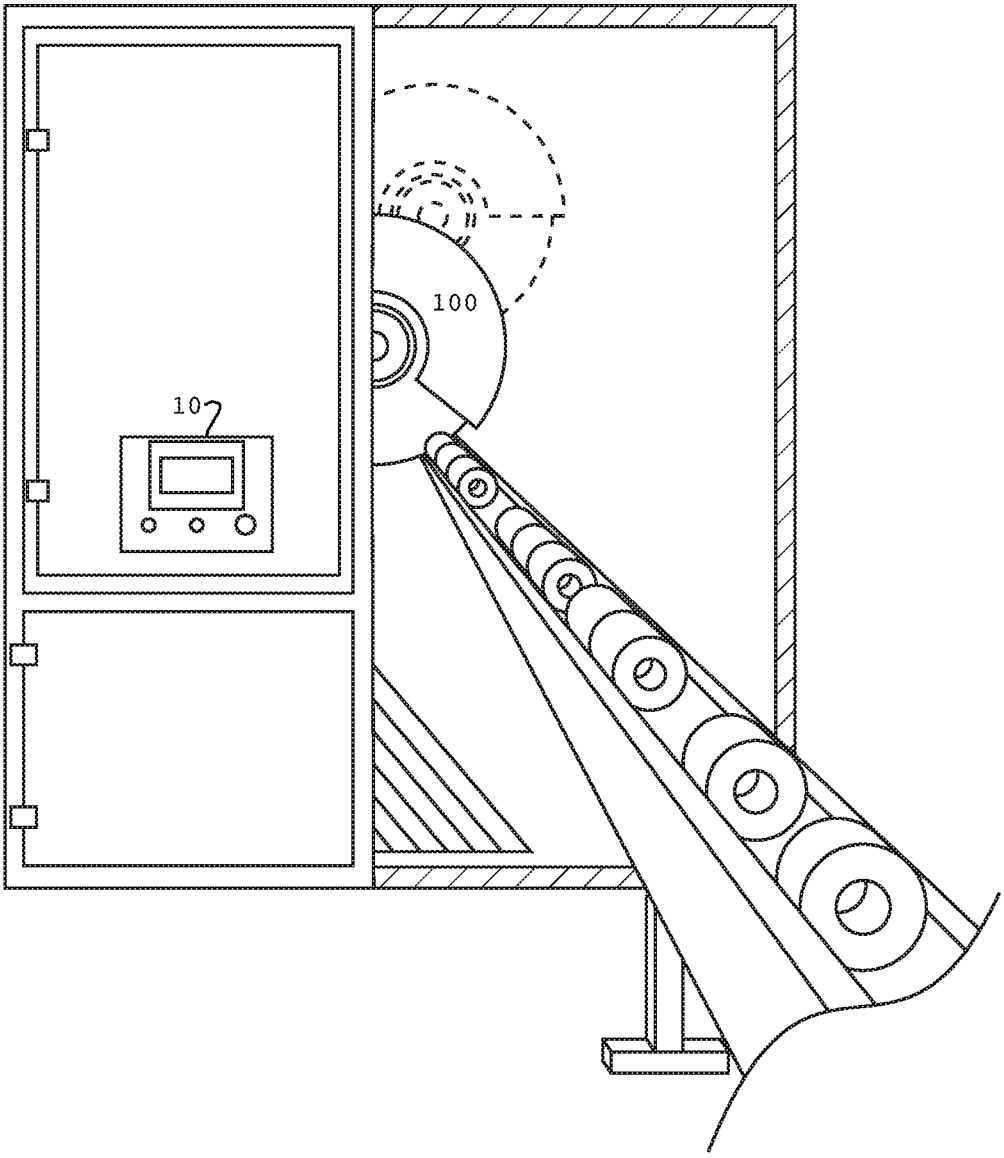
FIG. 3 (PRIOR ART)
FIG. 3 is a cutaway view of the front view of the prior art log saw system of FIG. 2.
Figure 4:
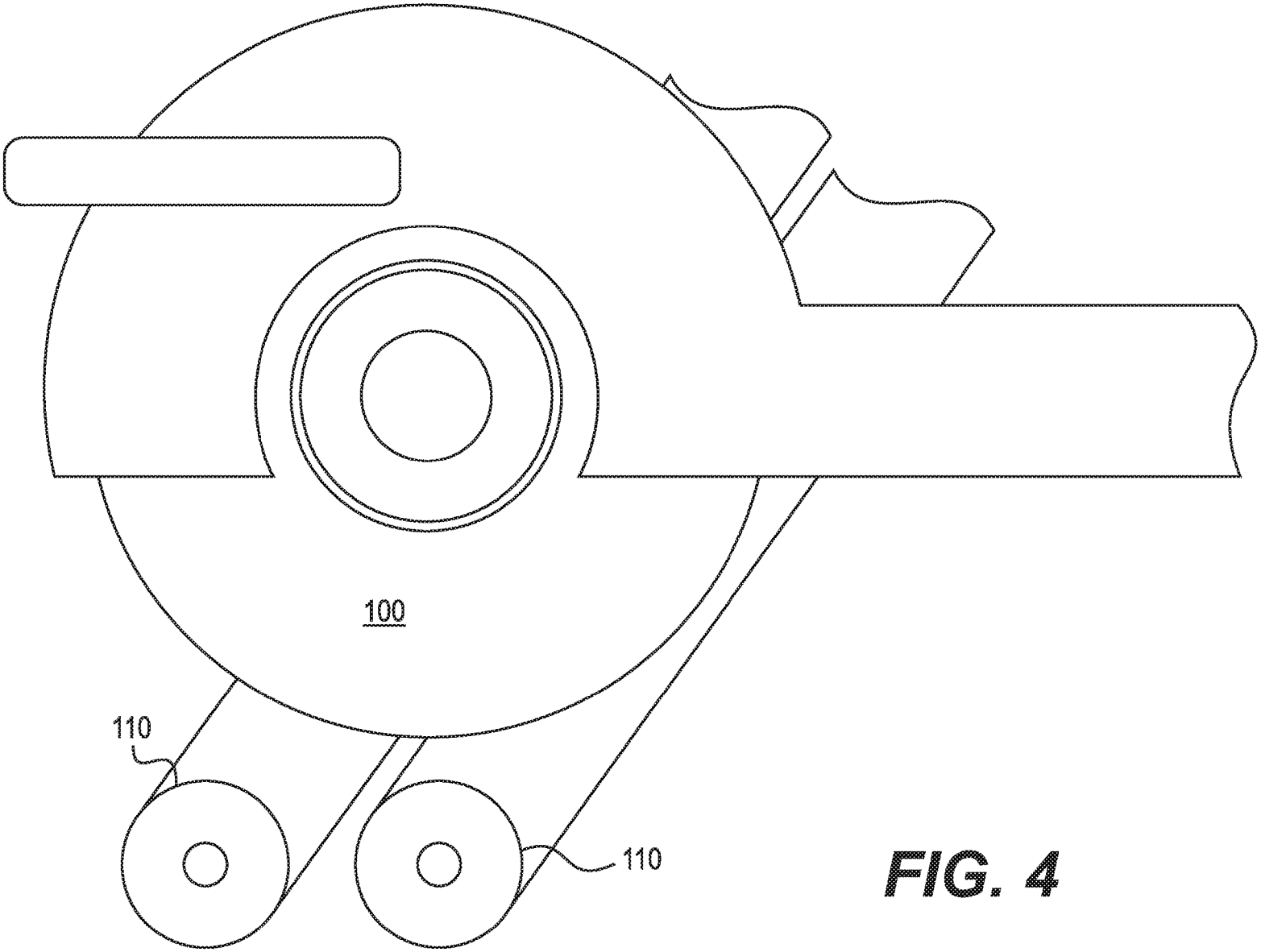
FIG. 4 is an exaggerated representation of a system for cutting a coreless rolled paper product.

FIG. 4 is an exaggerated illustration of a log sawing system through which the cutting of a coreless rolled paper product may be implemented consistent with the disclosed embodiments. FIG. 4 illustrates a saw 100 and coreless rolls 110. The saw 100 is lowered from a raised first position to a lower second cutting position where it engages the rolls 110 and cuts smaller consumer sized roll products from the paper log. FIG. 4 also illustrates an embodiment whereby the rolls 110 are rotated making it possible for the saw blade to articulate only as far as the center of the rolls. The system may include a controller (not shown) communicatively coupled to saw 100. Other controls and inputs, such as sensors and user input devices consistent with the disclosed embodiments that are not shown in FIG. 4 may also be included.

The controller 10 may embody a single microprocessor or multiple microprocessors that include a means for controlling the operation of the saw 100 and for receiving signals from other components. Numerous commercially available microprocessors can be configured to perform the functions of the controller 10. It should be appreciated that the controller 10 could readily embody a general machine or engine microprocessor capable of controlling numerous machine or engine functions. The controller 10 may include all the components required to run an application such as, for example, a memory, a secondary storage device, and a processor, such as a central processing unit or any other means known. Various other known circuits may be associated with the controller 10, including power source circuitry and other appropriate circuitry. The controller 10 may be programmed to control one or more of the plunge speed or the blade speed of saw 100.

Figure 5:
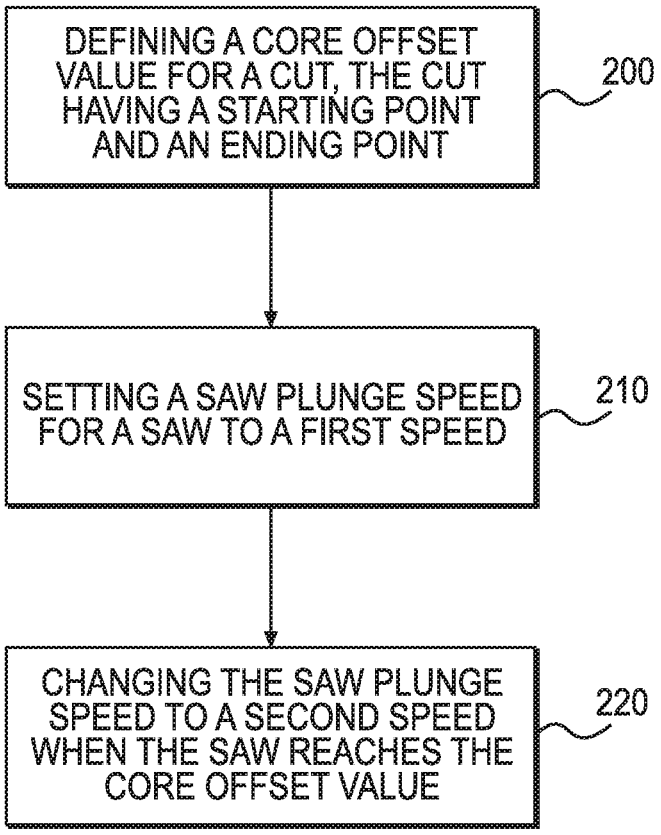
FIG. 5 is a flow chart illustrating a method for cutting a coreless rolled paper product.

FIG. 5 is a flowchart of an exemplary method for cutting a coreless rolled paper product. At step 200, the method may include defining a core offset value for a cut. A core offset value may be determined based on the type of tissue being cut, the cross section of the coreless rolled paper product and the cut itself.

Figure 6:
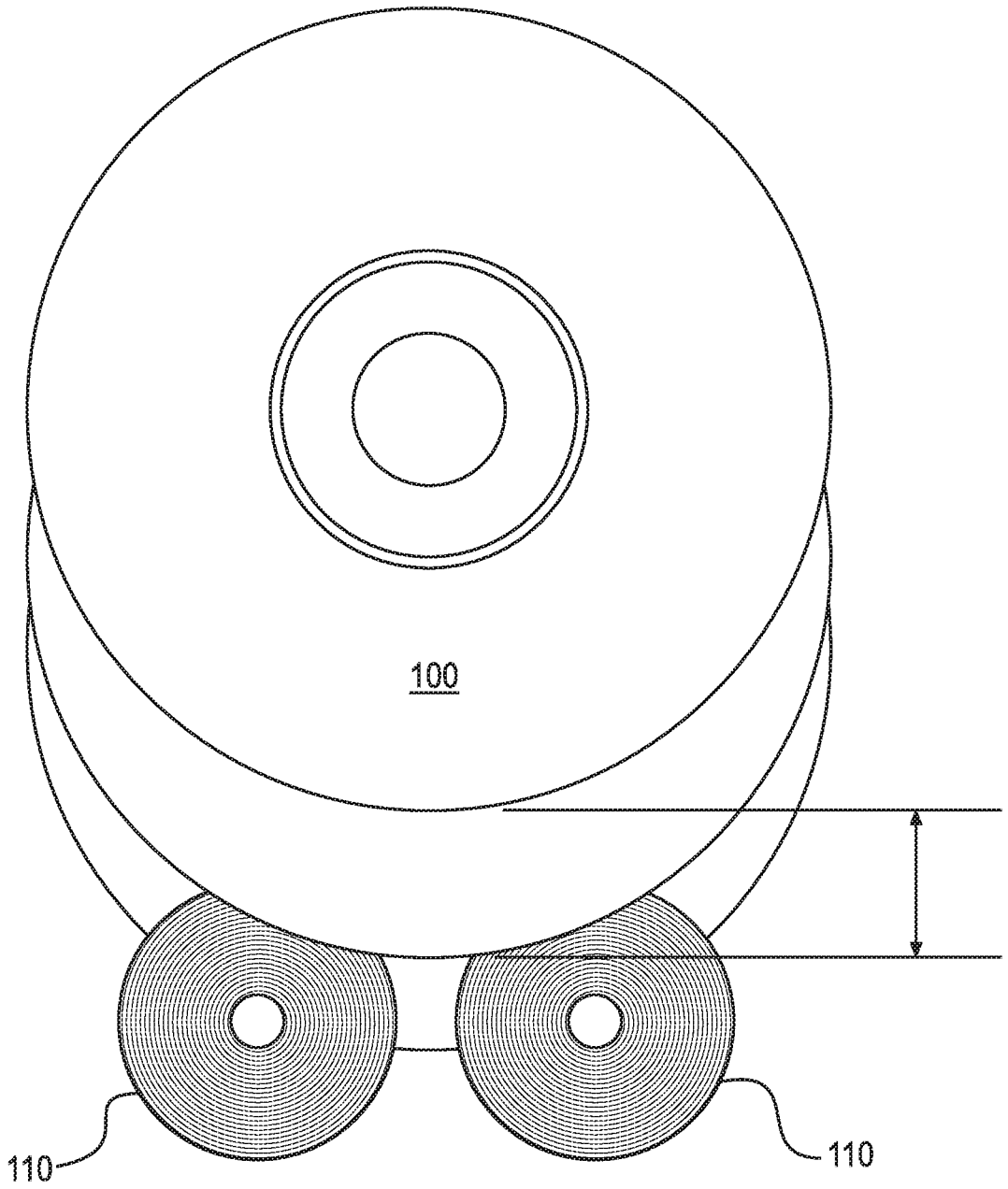
FIG. 6 illustrates a saw blade in a raised position and a lowered position and shows an example of an offset value.

FIG. 6 illustrates a saw 100 in a raised position and the same saw 100 as it is articulated downward through the paper roll to complete its cut. The saw 100, set in the foreground of FIG. 6, is the saw represented at its first cutting position. The second saw 100, in the center of FIG. 6, represents the blade as it reaches the core offset value. The final position, represented by the backmost saw 100 in FIG. 6, is the completion of cutting, when the segmented roll is fully released. The saw 100 is then withdrawn and the paper log is indexed to the next cutting point.

When the saw 100 reaches a position in the roll represented by the core offset value, the plunge rate of the saw blade is changed, and according to one embodiment, it is reduced until the saw 100 completes the cut at its final position in the center of the hollow core of the coreless roll product.

Figure 7B:
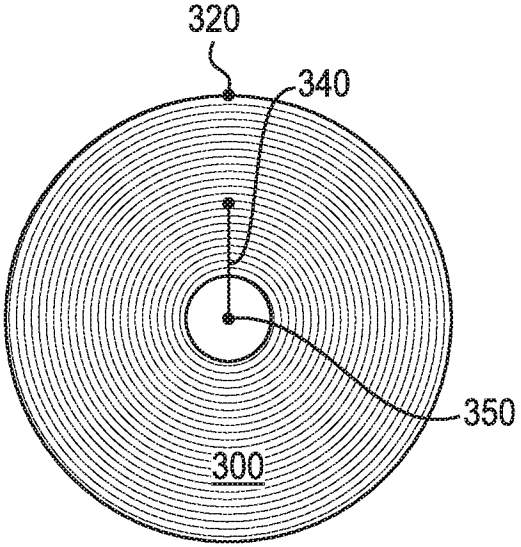
FIGS. 7A-7B illustrate different ways to measure a core offset value for a coreless rolled paper product.
Figure 7A:
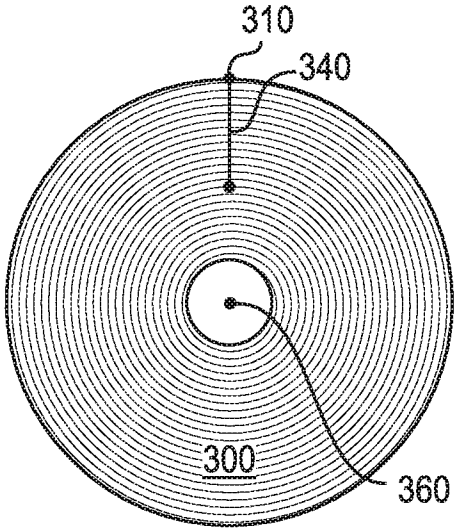

FIGS. 7A-7B illustrate exemplary alternatives for defining a core offset value. These figures each illustrate a cross-section of a coreless rolled paper product 300 that may be cut using the systems and/or methods disclosed herein. The coreless rolled paper product 300 may have a hollow core 360. Saw 100 may be used to cut coreless rolled paper product 300. The cut may have a starting point 310 or 320, and in a preferred embodiment have an ending point in the center of hollow core 360. For example, in FIG. 7B, starting point 320 and center point 350 are the outside and center points of coreless rolled paper product 300, respectively.

In some embodiments, core offset value, represented by the line 340 in FIGS. 7A and 7B may be determined as a distance from starting point 310, as shown in FIG. 7A, where the distance is measured along a line between starting point 310 and hollow core 360. As can be seen in FIG. 7A, the distance is less than the complete length between starting point 310 and hollow core 360, but the distance could be longer or shorter than what is shown in FIG. 7A.

Additionally or alternatively, core offset value 340 may be related to a distance from a center point 350 of coreless rolled paper product 300. For example, core offset value 340 may be a distance measured from center point 350, wherein the distance is measured along a line between center point 350 and starting point 320 as shown in FIG. 7B. A controller may be configured to determine a core offset value 340 for all or less than all of these methods of measuring a core offset value 340.

Additionally or alternatively, the controller may base core offset value 340 on other data related to saw 100 and/or coreless rolled paper product 300. For example, core offset value 340 may be related to the basis weight, the tear strength, the density and other characteristics of coreless rolled paper product 300.

In most embodiments, the core offset value 340 will be determined, at least in-part, on the speed at which the saw 100 will rotate. A desired maximum saw speed may be based on the specifications of saw 100, characteristics of coreless rolled paper product 300, end product qualities, and/or other factors, such as safety concerns and operating procedures. Desired maximum saw speed may be a value set by user input. The saw speed is generally set as high as possible without causing damage to the roll product. When the saw speed is set too high, for example, the product roll and the log roll may exhibit "grass" at the boundary of the cut.

Returning to FIG. 5, the method for cutting coreless rolled paper product 300 may include step 210, setting a first plunge speed for saw 100. Setting a first plunge speed may include calculating the saw speed, the desired throughput rate, and the second plunge speed. The second plunge speed and the core offset value may be set to achieve the desired effect of minimized compaction at the hollow roll core.

Throughput rate can be a primary driver in setting the saw and plunge speeds. Throughput rate is the number of cuts saw 100 is expected to perform over a certain amount of time. The controller may determine the throughput rate based on operating characteristics of saw 100 and/or other components that may be used in conjunction with saw 100 (not shown). Throughput rate may likewise be a value set by user input. Throughput is often dictated by either a desired output or the time necessary for the paper log to pass through this cutting section of the converting operation. According to one embodiment, to maintain continuity of throughput, the first plunge speed may be increased to offset the second, slower, plunge speed.

Returning to FIG. 5, the method for cutting a coreless rolled paper product 300 may include step 220, which is changing the first plunge speed to a second plunge speed when saw 100 reaches the core offset value. For example, a controller may be configured to determine when core offset value 340 has been reached, and send a control signal to the saw 100 indicating that core offset value 340 has been reached. This may further include setting a deceleration rate, or the rate by which the plunge speed of saw 100 changes from the first plunge speed to a second plunge speed. Deceleration rate may depend upon the operation of saw 100, or it may be related to features of coreless rolled paper product 300. Additionally or alternatively, the controller may determine deceleration rate based on user input. Step 220 may include changing the speed of saw 100 from the first plunge speed to the second plunge speed at the deceleration rate.

The controller may be configured to determine a deceleration point based on the core offset value and the first plunge speed and send a control signal indicative of at least one of the deceleration rate and the deceleration point to the saw 100 through the output. The controller may be further configured to determine when saw 100 has reached a deceleration point, wherein the control signal may be sent, when the deceleration point has been reached. According to some embodiments, the controller may be configured to decelerate saw 100 at the deceleration rate when saw 100 reaches core offset value 340. According to other embodiments, the controller may be configured to decelerate saw 100 at the deceleration rate such that when saw 100 reaches the core offset value 340, the saw 100 is operating at the second plunge speed.

In another embodiment, the plunge speed of the saw may be regulated based upon more than a single core offset value. The differing plunge speed patterns (including, for example, first speed, the deceleration and second speed) may be referred to as the profile variance of the plunge speed of the saw. For example, the saw 100 may begin the cut of the master roll at the starting point 310 and at the first core offset value, the saw 100 may begin to decelerate. Subsequently, the saw 100 may reach a second core offset value along the cutting path (not shown) and the saw 100 may maintain a second speed or again accelerate or further decelerate when this second core offset value is reached. Based upon the instant disclosure, the skilled artisan would recognize that multiple core offset points may be calculated or set to manipulate the saw speed to improve the cut precision without damage to the roll product. The use of three or more core offset points are contemplated in the instant invention.

According to one example, the method includes setting a plunge speed for saw 100 to a first speed, reaching a first core offset value and decelerating the saw speed to a second plunge speed, reaching a second core offset point and again accelerating the saw plunge speed. Such an embodiment may be useful, for example if the paper logs are not rotating and the cut is made over the entire diameter of the roll.

In one embodiment, where the coreless roll is designed to have the same core diameter as cores used in traditional cored products, the same machines and processes that can be used to produce cored products can be used to produce the disclosed coreless product.

EXAMPLES

A typical log saw arrangement used commercially was modified to slow the plunge speed of the saw at a core offset value that minimized core crush. Coreless bathroom tissue products were cut from a log roll using a saw that ran at dual plunge speeds. The tissue roll products exhibited significantly less core crush than similar tissue rolls cut using only a single plunge speed. In addition to the benefits achieved in the shape of the core opening, the change in plunge characteristics resulted in a prolonged viability of the saw blade.

When the system was further modified to increase the first plunge speed to offset the reduced second plunge speed, the system was able to generate more cuts per minute and also resulted in an extra week of saw blade time.

It will be apparent to those skilled in the art that various modifications and variations can be made to the system for cutting a coreless rolled paper product and associated methods for operating the same. Other embodiments of the present disclosure will be apparent to those skilled in the art from consideration of the specification and practice of the present disclosure. It is intended that the specification and examples be considered as exemplary only, with a true scope of the present disclosure being indicated by the following claims and their equivalents.

What is claimed is:

1. A method for cutting a coreless rolled paper product with a saw, the method comprising:

inputting to a saw controller comprising a microprocessor one or more of a core offset value, a cut starting point, a cut ending point, a throughput rate of the saw, a first plunge speed of the saw, a second plunge speed of the saw, or other variables identified to the controller to calculate one or more of the core offset value, the cut starting point, the cut ending point, the throughput rate of the saw, the first plunge speed of the saw, or the second plunge speed of the saw, wherein the core offset value correlates to a distance from the starting point of the cut, wherein the distance is measured along a line between the starting point and the ending point; cutting the coreless roll from the cut starting point to the core offset value;

changing the first plunge speed of the saw to a second plunge speed of the saw when the saw reaches the at least one core offset value; and cutting the coreless roll from the offset value to the cut ending point at the second plunge speed.

2. The method of claim 1, wherein changing the first plunge speed to a second plunge speed when the saw reaches the core offset value further includes:

setting a deceleration rate; and changing the saw speed from the first plunge speed of the saw to the second plunge speed of the saw at the deceleration rate.

3. The method of claim 2, wherein changing the first plunge speed of the saw to a second plunge speed of the saw when the saw reaches the core offset value further includes beginning to decelerate the plunge speed of the saw at the deceleration rate when the saw reaches the core offset value.

4. The method of claim 2, wherein changing the first plunge speed of the saw to a second plunge speed of the saw when the saw reaches the core offset value further includes beginning to decelerate the plunge speed of the saw at the deceleration rate so that the saw operates at the second plunge speed of the saw when the saw reaches core offset value.

5. The method of claim 1, wherein setting a saw plunge speed at a first plunge speed of the saw further includes:

identifying a desired maximum first plunge speed of the saw, a desired maximum second plunge speed of the saw, and a throughput rate of the saw;

calculating the first plunge speed of the saw and the second plunge speed of the saw based on the throughput rate, wherein the first plunge speed of the saw does not exceed the desired maximum first plunge speed of the saw and the second plunge speed of the saw does not exceed the desired maximum second plunge speed of the saw.

6. The method of claim 5, wherein the first plunge speed of the saw is calculated based upon setting the second plunge speed of the saw to its desired maximum and maintaining throughput rate.

* * * * *